US005852972A

United States Patent [19]

Wolstenholme

[11] Patent Number: 5,852,972

[45] Date of Patent: Dec. 29, 1998

[54] TRANSFER PRINTING PAD SOCKET ASSEMBLY

[76] Inventor: Marc W. Wolstenholme, 424 Austin Farm Rd., Exeter, R.I. 02822

[21] Appl. No.: 10,607

[22] Filed: Jan. 22, 1998

[51] Int. Cl.[6] ..... B41F 17/00

[52] U.S. Cl. ..... 101/41; 101/163

[58] Field of Search ..... 101/35, 41, 42, 101/43, 44, 150, 163, 167, 169, 170

[56] References Cited

U.S. PATENT DOCUMENTS

| | | | |
|---|---|---|---|
| 2,616,368 | 11/1952 | Hochman | 101/333 |
| 2,688,307 | 9/1954 | Nichols et al. | 118/264 |
| 3,279,359 | 10/1966 | Meyer | 101/1 |
| 4,709,633 | 12/1987 | Woestman | 101/163 |
| 4,738,199 | 4/1988 | Chen | 101/163 |
| 4,996,921 | 3/1991 | Hong | 101/333 |
| 5,261,325 | 11/1993 | Bengtsson | 101/327 |
| 5,452,658 | 9/1995 | Shell | 101/41 |

FOREIGN PATENT DOCUMENTS

| | | |
|---|---|---|
| 2 340 438 | 2/1976 | France . |
| 23 37 052 | 2/1976 | Germany . |

*Primary Examiner*—Edgar Burr
*Assistant Examiner*—Amanda B. Sandusky
*Attorney, Agent, or Firm*—Barlow & Josephs, Ltd.

[57] ABSTRACT

A print pad socket assembly for transfer printing is provided. The print pad socket assembly includes a socket member having a side wall and a central post member. A print pad is hand-installed into the socket and includes a seat region for securing the central post of the socket. The outer wall of the socket and central post provides peripheral and internal support, respectively, for the print pad to improve overall wear life. The socket is fastened to a printing machine armature plate a single time and when a print pad wears out, only the print pad itself is replaced which saves time and expense during operation.

15 Claims, 8 Drawing Sheets

TRANSFER PRINTING PAD SOCKET ASSEMBLY

BACKGROUND OF THE INVENTION

The present invention relates generally to a print pad assembly for printing machines. More specifically, the present invention relates to a transfer printing pad socket assembly for transfer printing machines.

In the field of transfer printing, it has been well-known to employ printing machines for delivering ink to a workpiece. In the prior art, it has been well known to employ a transfer print pad connected to an armature plate of a printing machine. Known transfer printing pads typically include a silicone rubber pad which is bonded or glued to a mounting base of metal, wood, plastic, or the like. In addition, it is also possible to mold the silicone rubber pad directly to the base member. The pad construction is mounted to the printing machine with the silicone pad member exposed and in an inverted position in preparation for the print process.

In transfer printing, a plate is etched in a desired configuration representing the desired indicia to be printed on the workpiece. Printing media, such as ink, is then introduced onto the plate and then cleared therefrom to leave ink pooled within the etched grooves representing the indicia to be transferred and printed to the workpiece. The transfer print pad is then indexed into place over the etched portion of the plate and is then placed into direct communication with the pooled ink to lift it from the etched plate while maintaining it in the desired arrangement. The print pad is then indexed by the printing machine to the workpiece, such as a golf ball, writing instrument barrel, or the like. The surface of the workpiece to be printed is then impacted by the print pad thus transferring the ink from the print pad to the workpiece in the desired configuration. The workpiece is then removed and the print pad is registered again with the etched portion of the plate in preparation for repetition of the transfer print cycle.

In a typical transfer printing machine, a carrier plate is employed to position one or an array of transfer print pads. Each print pad, consisting of a silicone rubber portion directly molded to or bonded to a hard base member, is fastened to the pad carrier plate of the printing machine. Commonly, threaded screws are passed through the carrier plate to engage with a female threaded bore on the mounting plate of the printing pad member. An array of such printing pad constructions are employed to correspond with an array of etchings on the ink plate to multiply the number of printings per cycle. Upon reaching a predetermined number of cycles or when the print quality becomes unacceptable, the print pads must be changed.

Due to the demand for a print pad assembly which can provide a quality ink transfer at low cost, it is desirable for a print pad assembly to include a quality pad member which is inexpensive and easy to replace during the printing cycle, as needed. It is also desirable to include a printing pad assembly which permits easy replacement of the printing pad without the need for additional tools and which could be accomplished quickly and easily. It is also desirable that the printing pad assembly have a standard configuration for direct installation into existing transfer printing machines.

SUMMARY OF THE INVENTION

The present invention preserves the advantages of prior art transfer printing pad assemblies for transfer printing machines. In addition, it provides new advantages not found in currently available printing pad assemblies, and overcomes many disadvantages of such currently available printing pad assemblies.

The invention is generally directed to a novel and unique transfer printing pad socket assembly with particular application in transfer printing machines. The transfer printing pad socket assembly of the present invention enables the simple, easy and inexpensive assembly, use and maintenance of a transfer printing machine while producing quality transfer printing.

The preferred embodiment of the present invention includes two primary members. A cup-shaped mounting socket includes a floor and upstanding walls and defines a pad layout configuration. The mounting socket also includes an upstanding post member, having a post height, which is connected to and emanates upwardly from the floor of the cup-shaped mounting socket. Also provided is a printing pad member which has an upper printing surface and a lower mounting surface. The printing pad member includes a post seat region which extends from the lower mounting surface up into the printing pad member a distance substantially equal to the height of the post. The printing pad member is dimensioned substantially identical to the pad layout configuration and is frictionally engageable with the cup-shaped mounting socket with the lower mounting surface of the printing pad member being in communication with the floor of the upstanding post member residing within the seat region. The printing pad member is removable from the cup-shaped mounting socket for easy replacement when worn. Also, a female threaded aperture is provided through the bottom of the cup-shaped mounting socket for receipt of a male threaded screw for fastening to a transfer printing machine.

It is therefore an object of the present invention to provide a transfer printing pad socket assembly that can produce quality transfer printing.

Another object of the present invention is to provide a transfer print pad socket assembly with a print pad that can be easily and quickly replaced when worn without the use of additional tools.

It is another object of the present invention to provide a transfer print pad socket assembly that can be replaced when worn without disturbing the alignment or height of the assembly.

It is a further object of the present invention to provide a transfer print pad socket assembly that has superior cycle wear life over prior art pad assemblies.

It is yet a further object of the present invention to provide a transfer print pad socket assembly that is less expensive to manufacture than prior art pad assemblies.

It is another object of the present invention to provide a transfer print pad socket assembly that provides higher quality transfer printing at lower cost compared to prior art pad assemblies.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
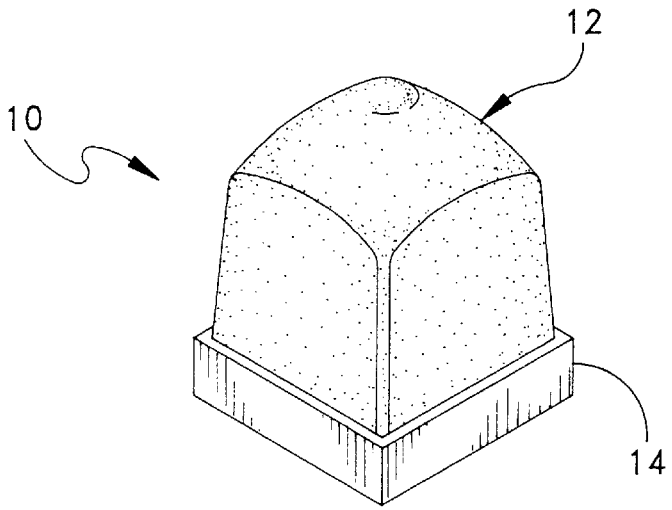
FIG. 1 (PRIOR ART)
FIG. 1 is a perspective view of a prior art transfer print pad assembly.
Figure 2:
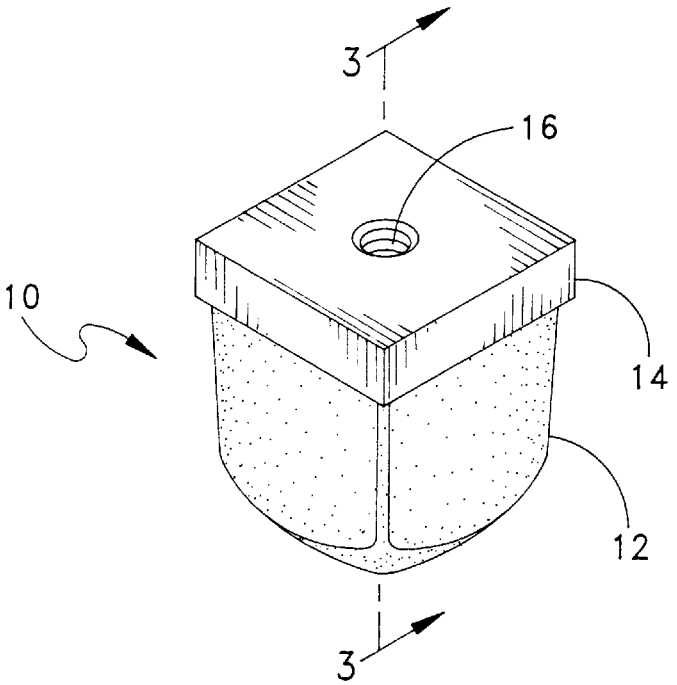
FIG. 2 (PRIOR ART)
FIG. 2 is an inverted perspective view of the prior art transfer print pad assembly of FIG. 1.

Referring first to FIGS. 1–4, a prior art print pad assembly is shown. As seen in FIGS. 1 and 2, prior art transfer print pad 10 is provided with pad member 12 mounted on mounting base 14. Pad member 12 is typically silicone rubber, but could be other materials. Female threaded aperture 16 is also commonly included in a prior art printing pad assembly 10 to facilitate mounting to a transfer printing machine (not shown).

Figure 3:
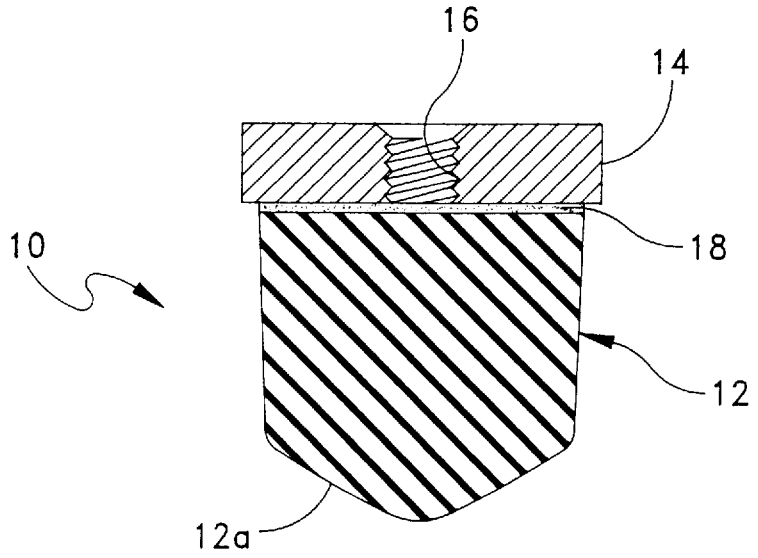
FIG. 3 (PRIOR ART)
FIG. 3 is cross-sectional view through the line 3—3 of FIG. 2.

Referring now to FIG. 3, a cross-sectional view through the line 3—3 of FIG. 2 is shown to illustrate the construction of prior art transfer print pad 10. Mounting base 14 may be metal, wood, plastic or any other suitable material for supporting prior art transfer print pad 10. Silicone rubber pad member 12 is commonly secured to mounting base 14 by adhesive layer 18 which may be any type of high-strength glue or bonding agent suitable for silicone rubber. Alternatively, prior art pad member 12 may be molded directly to mounting base 14 to facilitate the manufacturing process. In all prior art transfer print pad assemblies 10, pad member 12 is permanently affixed to mounting base 14 in preparation for use on an actual print transfer printing machine.

Figure 4:
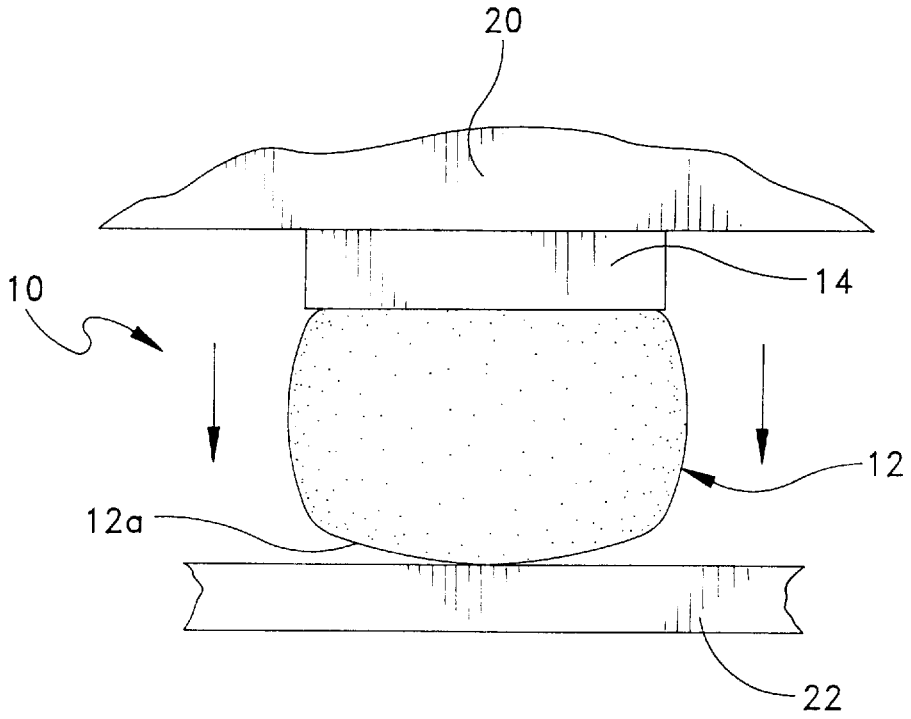
FIG. 4 (PRIOR ART)
FIG. 4 is a side view of the prior art transfer print pad assembly of FIG. 1 during the printing process.

As seen in FIGS. 2 and 3, female threaded aperture 16 is provided for facilitating the mounting of the prior art transfer print pad assembly 10 to a printing machine. FIG. 4 illustrates the prior art transfer print pad assembly 10 installed on an armature plate of a printing machine, generally referenced as 20. Commonly, a male threaded screw is passed through an aperture in armature plate 20 of the printing machine so as to engage female threaded aperture 16 in mounting base 14 to secure prior art transfer print pad assembly 10 to a printing machine for use.

In operation, as shown in FIG. 4, printing machine armature plate 20, carrying prior art pad assembly 10, picks up ink and is registered over a workpiece 22 to be printed, such as the barrel of a pen, golf ball, or the like. When the prior art pad assembly 10 is properly registered, it is lowered by printing machine armature 20 in a direction indicated by the arrows so as to impact workpiece 22 thus transferring ink thereto to complete the printing process. As can be seen in FIG. 4, print surface 12*a* of pad member 12 impacts workpiece 22 thus causing the sides of pad member 12 to bulge significantly during each print cycle resulting in wear to the pad member 12.

After a certain number of print cycles, the print quality on workpiece 22 will begin to degenerate thus indicating the need to change print pad assembly 10 for replacement with a new pad assembly. The replacement of a worn prior art transfer print pad assembly 10 with a new pad assembly requires armature plate 20 to be removed, in a multiple pad carrier configuration, from the transfer printing machine for the subsequent removal of fastening screws (not shown) to release mounting base 14 from armature plate 20. In a single pad array, the assembly is directly removed via fastener 138. This requires that the printing machine be stopped temporarily and that the person operating the machine locate the appropriate tool for removal of the male threaded fastener. Once the appropriate tool is found, such as a hex wrench or screw driver, the entire prior art printing pad assembly, including both the mounting base 14 and pad member 12, are completely removed and replaced with a new complete assembly 10.

Figure 5:
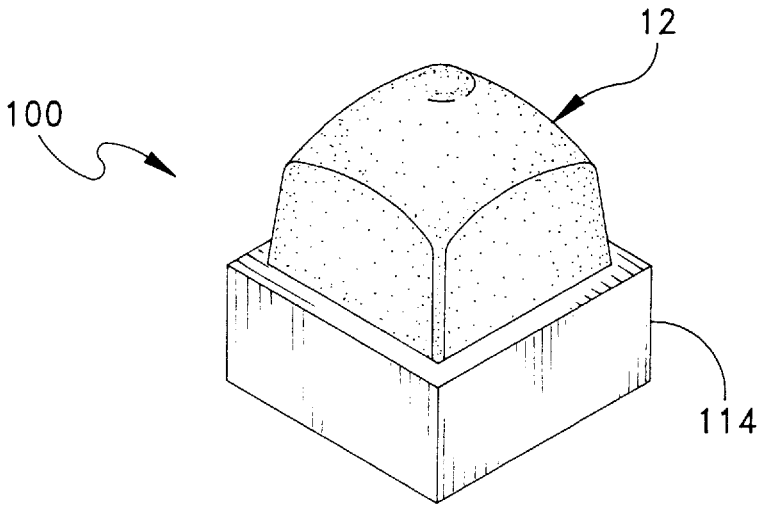
FIG. 5 is a perspective view of the preferred embodiment of the transfer print pad socket assembly of the present invention.
Figure 6:
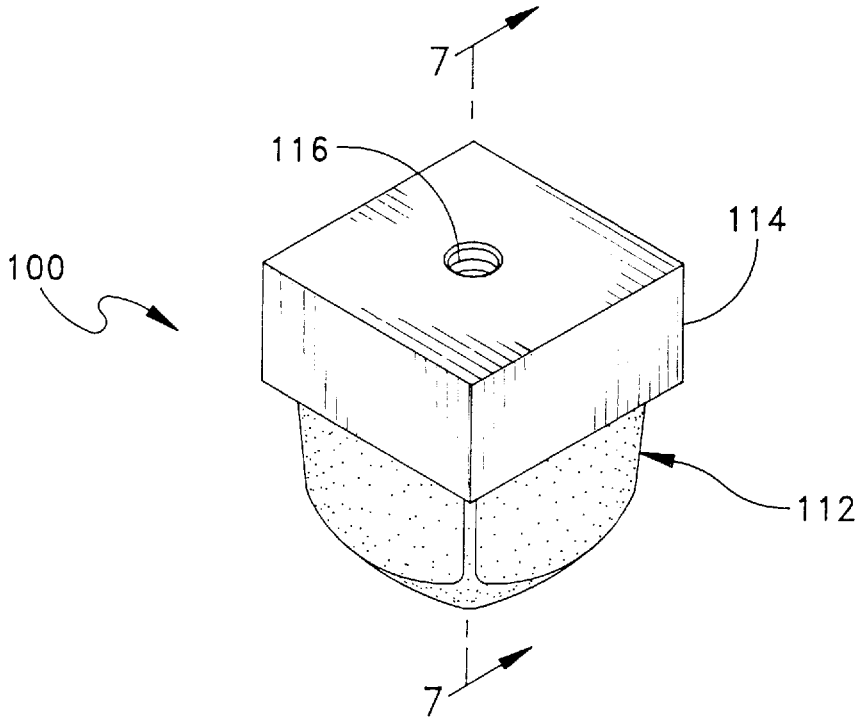
FIG. 6 is an inverted perspective view of the preferred embodiment of the transfer print pad socket assembly of the present invention.

Turning now to FIGS. 5–15, the transfer print pad socket assembly of the present invention is shown. Turning first to FIGS. 5–11, the preferred embodiment of the transfer print pad assembly 100 of the present invention is shown. FIG. 5 illustrates a perspective view of the preferred embodiment of the transfer print pad socket assembly 100 of the present invention. Transfer print pad socket assembly 100 includes pad member 112 installed within mounting socket 114. FIG. 6 illustrates an inverted perspective view of the preferred embodiment of the transfer print pad socket assembly 100 of the present invention. Mounting socket 114 preferably includes threaded aperture 116 to facilitate secure mounting to a printing machine (not shown) as will be shown in detail below.

Figure 7:
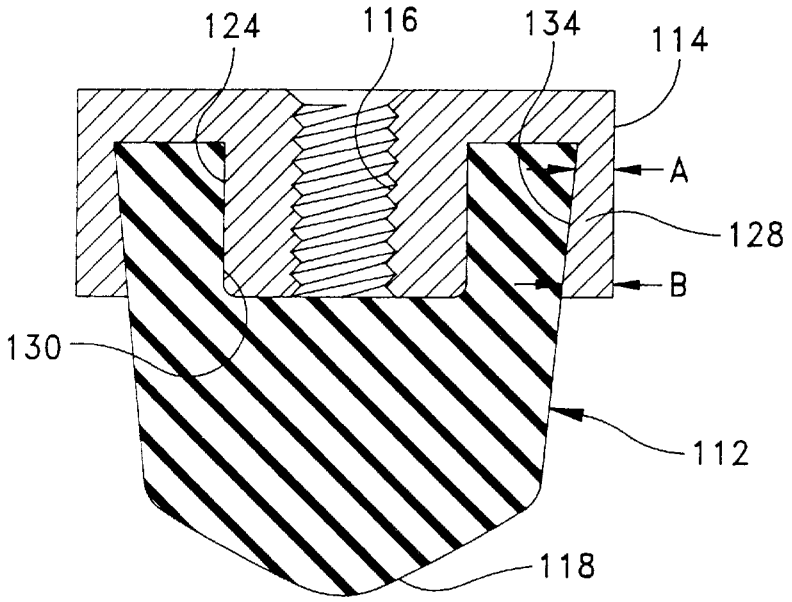
FIG. 7 is a cross-sectional view through the line 7—7 of FIG. 6.
Figure 8:
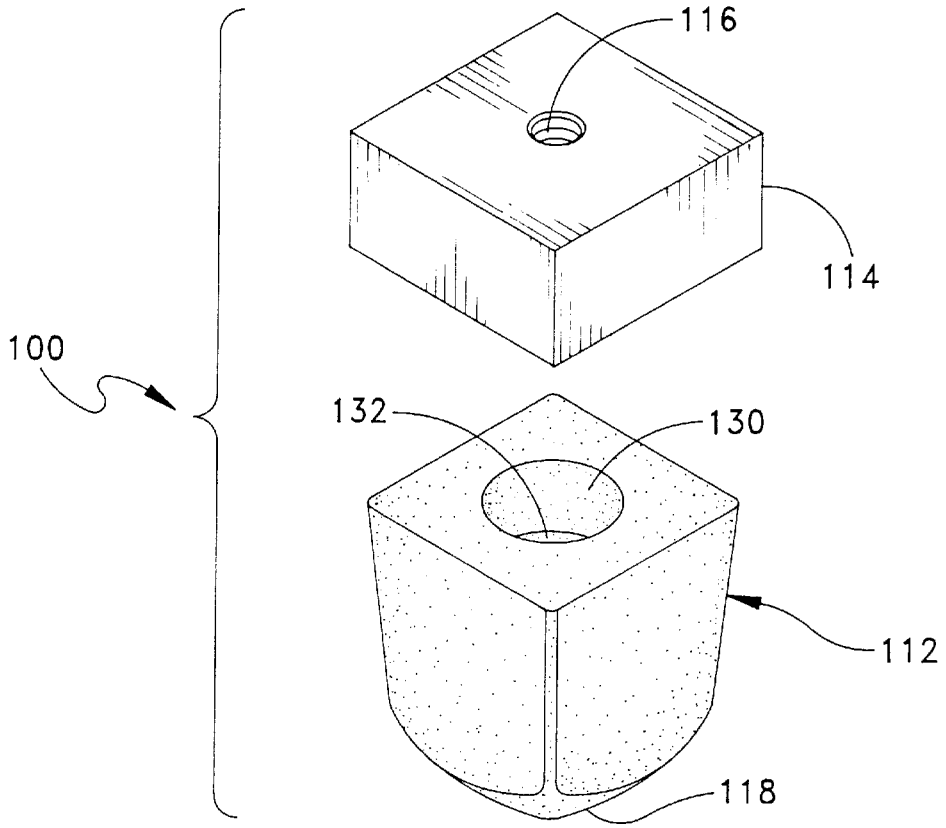
FIG. 8 is an exploded perspective view of the transfer print pad socket assembly of the present invention shown in FIG. 6.
Figure 9:
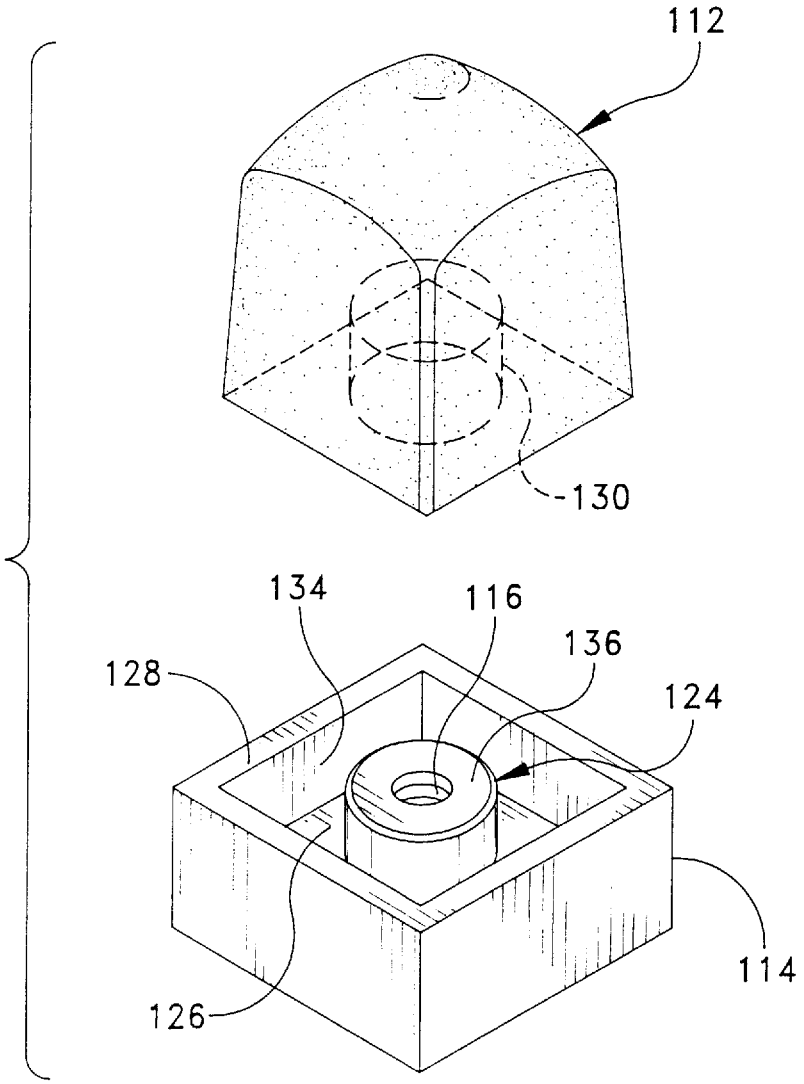
FIG. 9 is an exploded perspective view of the transfer print pad socket assembly of the present invention shown in FIG. 5.

Turning now to FIGS. 7–9, details of the construction of the transfer print pad socket assembly 100 of the present invention is shown. FIG. 7 illustrates a cross-sectional view through the line 7—7 of FIG. 6 where, generally, mounting socket 114 includes central post 124 with threaded aperture 116 therethrough. Pad member 112 includes a print transfer surface 118 as well as a post-receiving seat 130. Socket wall 128 includes an angled inner surface 134 which tapers inwardly toward central post 124 as it travels downwardly toward the open end of mounting socket 114. As a result, thickness A of socket wall 128 is slightly smaller than thickness B of socket wall 128. In addition, it is preferred that pad member 112 provides a complementary structure for tapered-in mounting socket wall 128. The outer surface of pad member 112 is angled slightly inward, in a fashion opposite to socket wall 128, to provide a taper-lock friction fit connection, even when the transfer print pad socket assembly 100 is in an inverted condition as shown in FIG.

7. Since pad member 112 is flexible silicone rubber, it can be easily installed into mounting socket 114 by hand. FIG. 8 further illustrates the interconnection of pad 112 into mounting socket 114 by illustrating post-receiving seat 130 and seat floor 132 in preparation for receipt of central post 124.

Turning now to FIG. 9, details of installation of pad member 112 into mounting socket 114 is shown. In particular, mounting socket 114 includes a socket floor 126 which supports central post 124 which includes threaded aperture 116 as well as a top surface 136. Socket walls 128 contain the entire mounting socket and provide inner wall surface 134 for laterally bounding and containing pad member 112. Threaded aperture 116 is shown to extend completely through central post 124; however, threaded aperture 116 may extend only partially up through post 124 so as to not extend through top surface 136. As described above, pad member 112 is installed into mounting socket 114 by a hand press-on fit where pad member 112 is frictionally secured to mounting socket 114.

Figure 10:
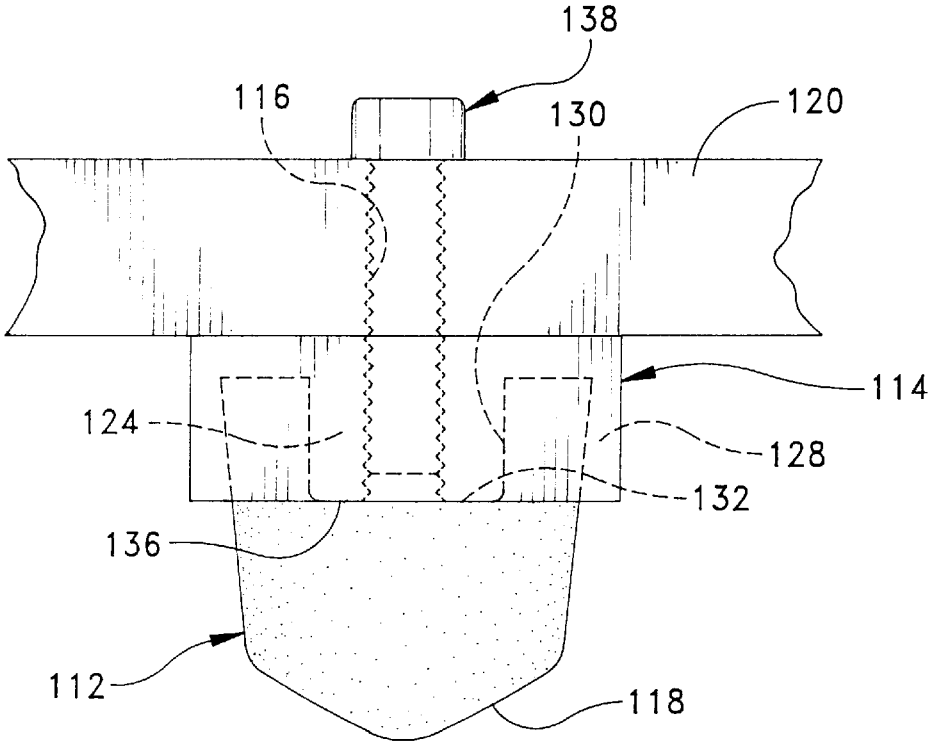
FIG. 10 is a side view of the transfer print pad socket assembly of the present invention installed on a printing machine armature.
Figure 11:
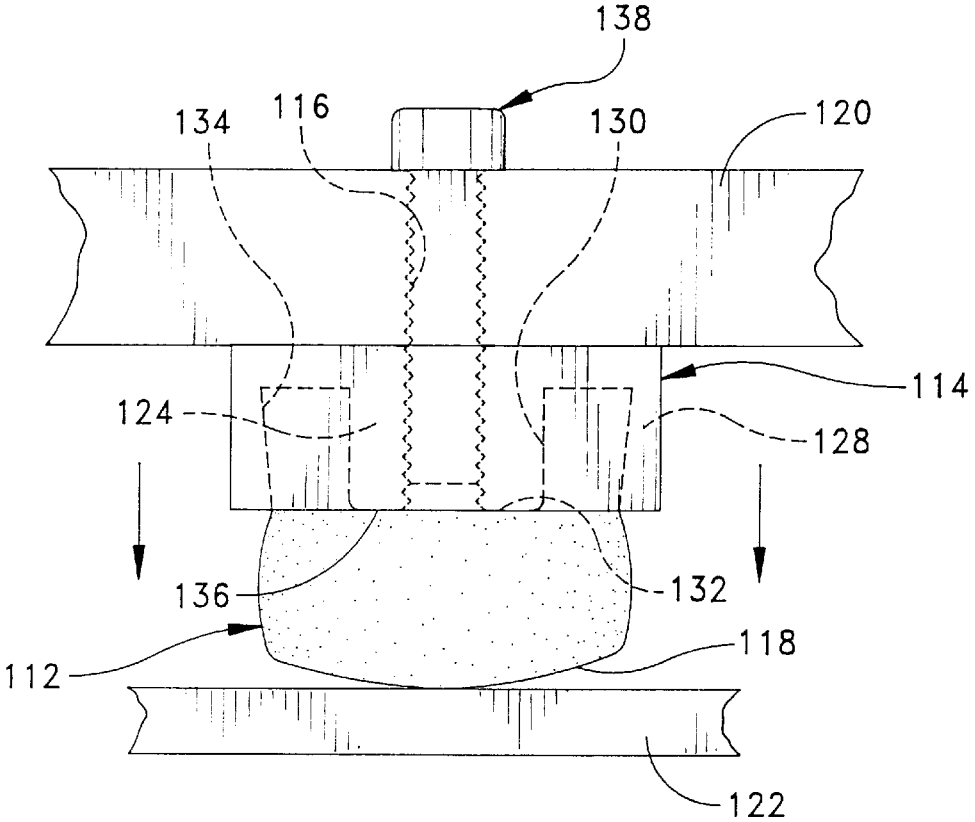
FIG. 11 is a side view of the transfer print pad socket assembly of the present invention during the printing process.

FIGS. 10 and 11 illustrate the use of the transfer print pad socket assembly 100 of the present invention in operation on a transfer printing machine. FIG. 10 illustrates the initial installation of the transfer print pad socket assembly 100 of the present invention. A printing pad machine armature plate 120 is provided which effectively moves the transfer print pad socket assembly into registry with, first, inked plates and, second, into registry with the desired workpieces to be printed upon. In FIG. 10, mounting socket 114 is secured to printing machine armature plate 120 by the engagement of threaded fastener 138 into threaded aperture 116 in mounting socket 114. This is a one-time operation in that mounting socket 114 need only be secured to printing machine armature plate 120 a single time because only pad member 112 will need to be removed when the pad assembly pad member 112 wears out. In this typical inverted condition, as shown in FIG. 10, pad member 112 resides within mounting socket 114 with top surface 136 of central post 124 being, preferably, flush with seat floor 132 of pad member 112. As a result, a snug fit is provided between pad member 112 and mounting socket 114 whereby central post 124 provides internal support for pad member 112 and socket wall 128 provides peripheral lateral bounding support for print pad 112.

After printing machine armature plate 120 is registered over an inked plate (not shown), pad member 112 is brought into communication therewith to pick up the desired ink. Armature plate 120 is then brought into registry with the desired workpiece 122, as shown in FIG. 11. To complete the transfer printing process, armature plate 120 of the transfer printing machine, is drawn toward workpiece 122 in the direction of the indicated arrows so that pad member 112 impacts the workpiece. As a result of this impact, the ink residing on transfer surface 118 is transferred to the workpiece 122 to complete the print process. During this impact, the side walls of pad member 112 will bow out slowly in a controlled manner due to the peripheral bounding control provided by mounting socket 114; namely, socket wall 128. In addition, central post 124 provides internal support for pad member 112 during impact.

As a result of the configuration and structure of the transfer print pad socket assembly 100 of the present invention, many more cycles can be executed before requiring replacement due to wear. Also, when replacement is necessary, only pad member 112 is removed and then replaced by hand as opposed to removing the entire printing machine armature plate 120 and unfastening the entire assembly therefrom which can only be taken out with the assistance of a tool. The transfer print pad socket assembly 100 of the present invention enables fast replacement of the pad member to realize less printing machine down time. In addition, the added peripheral and internal support for the pad member 112 causes it to wear much slower and, as a result, operate for many more cycles before replacement. In addition, the interaction of pad member 112 with mounting socket 114 creates a vacuum lock to further retain pad member 112 in place.

The transfer print pad socket assembly 100 was tested and compared to a prior art pad assembly as shown in FIGS. 1–4. Both the prior art pad assembly and transfer print pad socket assembly of the present invention were used to execute a full run of transfer printing the same indicia on golf balls. The average number of golf balls stamped per pad as well as average time to change a pad for replacement is outlined on the following table.

| | Average Number of Golf Balls Printed Before Replacement of Pad Required | Average Time to Remove a Worn Pad and Replace with a New Pad |
|---|---|---|
| Prior Art Pad Assembly (Single Piece Bonded to Base Member) | 29,000 | 62 seconds |
| New Inventive Pad Assembly (Socket and Pad assembly of present invention) | 60,540 | 29 seconds |

Figure 12:
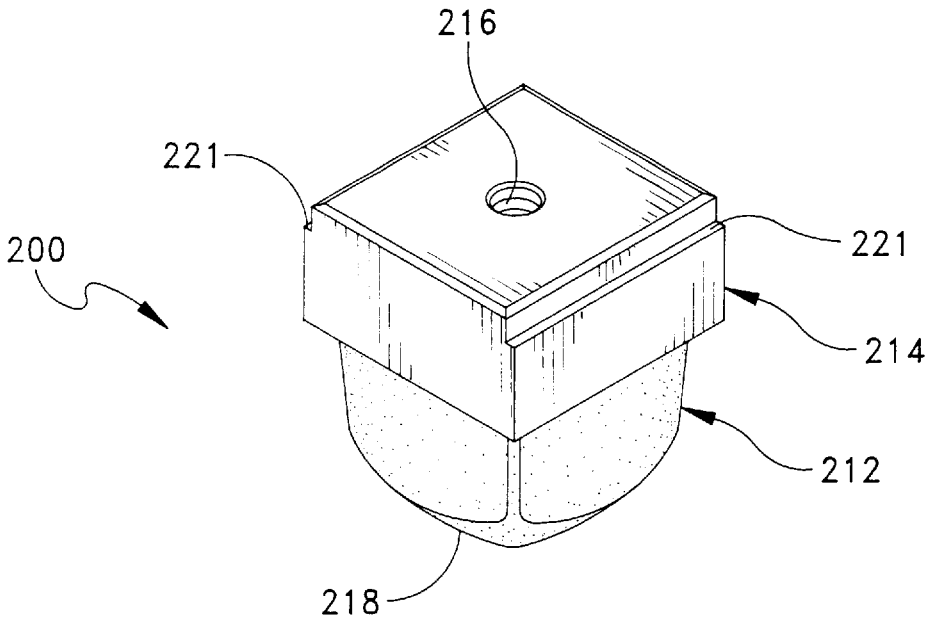
FIG. 12 is an inverted perspective view of a first alternative embodiment of the transfer print pad socket assembly of the present invention.
Figure 13:
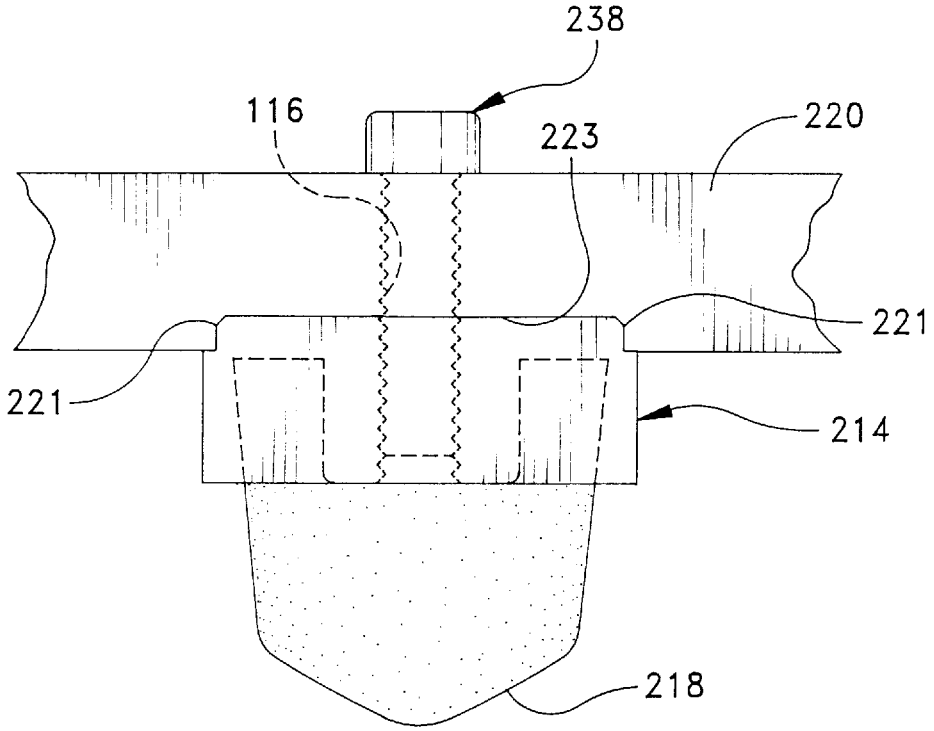
FIG. 13 is an end view of the first alternative embodiment shown in FIG. 12 installed on a printing machine armature.

FIGS. 12 and 13 illustrate an alternative embodiment of the transfer print pad socket assembly of the present invention. Alternative embodiment 200 includes mounting socket 214 for receiving pad member 212 therein in identical fashion as described above. A pair of notched keys 221 are provided on opposing sides of mounting socket 214 which, preferably, run the entire length of mounting socket 214. For the installation of the alternative embodiment 200, mounting socket 214 is abutted against printing machine armature plate 220 which includes a running groove 223 for complementary receipt of the reduced area portion of mounting socket 214 bounded by notched keys 221. Mounting socket 214 is permanently secured to mounting machine armature plate 220 in the usual fashion by threaded fastener 238. In the assembly shown in FIG. 13, embodiment 200 of the transfer print pad socket assembly is rotationally keyed relative to printing machine armature plate 220. As a result, over the course of many, many cycles of operation, assembly 200 will remain in the desired rotational alignment.

Figure 14:
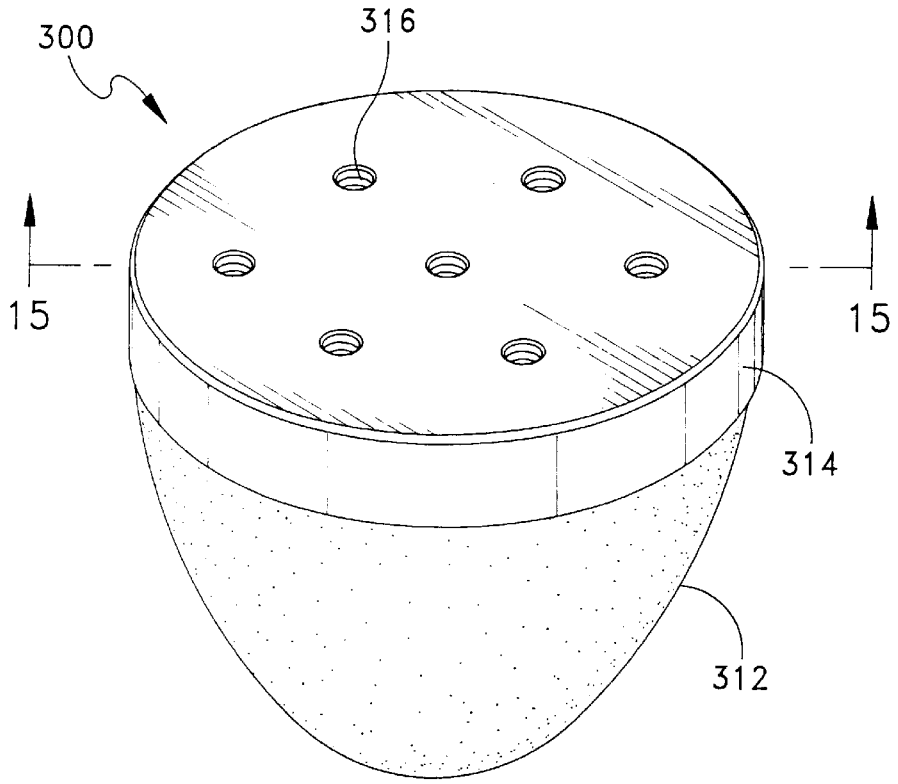
FIG. 14 is an inverted perspective view of a second alternative embodiment of the transfer print pad socket assembly of the present invention.
Figure 15:
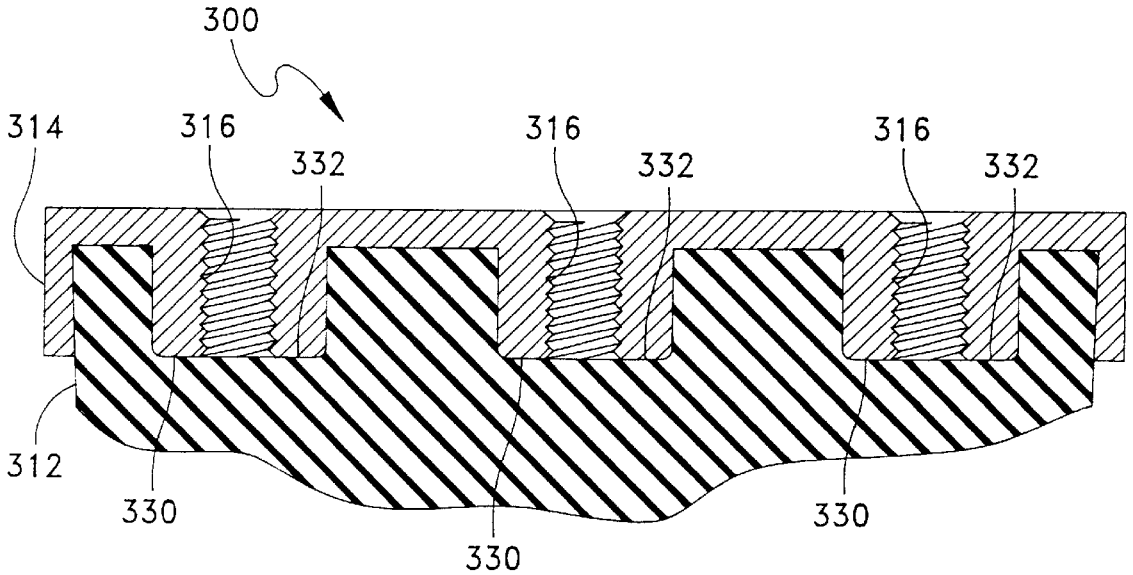
FIG. 15 is a cross-sectional view through the line 15—15 of FIG. 14.

FIGS. 14 and 15 illustrate a second alternative embodiment 300 of the transfer print pad socket assembly of the present invention. As compared to the preferred embodiment 100, second alternative embodiment 300 includes a round mounting socket 314 and round pad member 312 for installation therein. In addition, due to the larger size of second alternative embodiment of the transfer print pad socket assembly of the present invention, a number of posts 330 are provided within mounting socket 314. With a larger pad assembly, as shown in second alternative embodiment 300, additional internal stability is desirable to further increase their life. In addition, due to the larger size of assembly 300, additional threaded apertures 316 are provided within mounting socket 314 to facilitate the permanent mounting of mounting socket 314 to an armature plate of a transfer printing machine. It should be understood that various sizes and configuration of transfer print pad socket assemblies may be provided and still be within the scope and spirit of the present invention. For example, the shape and size of the assembly can be varied to accommodate the particular printing application at hand.

It would be appreciated by those skilled in the art that various changes and modifications can be made to the illustrated embodiments without departing from the spirit of the present invention. All such modifications and changes are intended to be covered by the appended claims.

What is claimed is:

1. A transfer print pad socket assembly for a printing machine, comprising:

a cup-shaped mounting socket having a floor and upstanding walls; said mounting socket defining a pad layout configuration;

an upstanding post member, having a post height, connected to and emanating upwardly from said floor of said cup-shaped mounting socket;

a printing pad member having an upper printing surface and a lower mounting surface; said printing pad member defining a post seat region extending from said lower mounting surface up into said printing pad member a distance substantially equal to said post height; said printing pad member being dimensioned substantially identical to said pad layout configuration and engageable with said cup-shaped mounting socket with said lower mounting surface of said printing pad member being in communication with said floor of said cup-shaped mounting socket and said upstanding post member residing within said seat region; said printing pad member being removable from said cup-shaped mounting socket; and connection means affixed to said cup-shaped mounting socket for securing said printing pad socket assembly to a transfer printing machine.

2. The transfer print pad socket assembly of claim 1, wherein said printing pad member is dimensioned slightly larger than said pad layout configuration for engagement with said cup-shaped mounting socket.

3. The transfer print pad socket assembly of claim 1, wherein said printing pad is manufactured of silicone rubber.

4. The transfer print pad socket assembly of claim 1, wherein said cup-shaped mounting socket is manufactured of plastic.

5. The transfer print pad socket assembly of claim 1, wherein said cup-shaped mounting socket is manufactured of metal.

6. The transfer print pad socket assembly of claim 1, wherein said connection means affixed to said cup-shaped mounting socket for securing said printing pad socket assembly to a transfer printing machine is a female threaded aperture capable of receiving a male threaded screw fastener.

7. The transfer print pad socket assembly of claim 1, wherein said upstanding post member is cylindrical in shape.

8. The transfer print pad socket assembly of claim 1, wherein said cup-shaped mounting socket is square in shape.

9. The transfer print pad socket assembly of claim 1, wherein said cup-shaped mounting socket is round in shape.

10. A transfer print pad socket assembly for a printing machine, comprising:

a cup-shaped mounting socket having a floor and side wall;

at least one post disposed on said floor defining a mounting socket configuration;

a print pad member having a print surface and an opposing mounting surface; said mounting surface including at least one seat member therein capable of receiving said at least one post; said mounting surface defining a mounting surface configuration; said mounting socket configuration and said mounting surface configuration being complementary to one another; said print pad member being frictionally mated with said cup-shaped mounting socket; and fastening means connected to said cup-shaped mounting socket for securing said cup-shaped mounting socket to a printing machine.

11. The transfer print pad socket assembly of claim 10, wherein said print pad is manufactured of silicone rubber.

12. The transfer print pad socket assembly of claim 10, wherein said cup-shaped mounting socket is manufactured of plastic.

13. The transfer print pad socket assembly of claim 10, wherein said cup-shaped mounting socket is manufactured of metal.

14. The transfer print pad socket assembly of claim 10, wherein said cup-shaped mounting socket is square in shape.

15. The transfer print pad socket assembly of claim 10, wherein said cup-shaped mounting socket is round in shape.

* * * * *